US006928774B1

(12) United States Patent
Weiss et al.

(10) Patent No.: US 6,928,774 B1
(45) Date of Patent: Aug. 16, 2005

(54) ENVELOPING BODY

(75) Inventors: Markus Weiss, Munich (DE); Frank Klein, Munich (DE)

(73) Assignees: blowUP media GmbH, Munster (DE); Streif Baulogistik GmbH, Essen (DE)

( * ) Notice: Subject to any disclaimer, the term of this patent is extended or adjusted under 35 U.S.C. 154(b) by 0 days.

(21) Appl. No.: 10/069,816

(22) PCT Filed: Aug. 4, 2000

(86) PCT No.: PCT/EP00/07598

§ 371 (c)(1),
(2), (4) Date: Feb. 27, 2002

(87) PCT Pub. No.: WO01/16926

PCT Pub. Date: Mar. 8, 2001

(30) Foreign Application Priority Data

Aug. 31, 1999 (DE) ..... 299 15 269 U

(51) Int. Cl.[7] ..... E04H 12/00; E04H 12/34

(52) U.S. Cl. ..... 52/111; 212/295; 212/296; 212/297; 212/299; 212/347; 212/348; 212/350; 212/271; 212/294; 52/121; 52/114

(58) Field of Search ..... 52/111–124.2, 52/737.4, 737.5, 738.1, 108, 115, 40, 6; 343/883, 343/875, 901; 212/294, 298, 296, 249, 297, 212/299, 347, 348, 350, 271; 40/606.03, 40/791, 607.03

(56) References Cited

U.S. PATENT DOCUMENTS

| | | | | | |
|---|---|---|---|---|---|
| 1,319,943 | A | * | 10/1919 | Bessolo | 182/129 |
| 2,265,892 | A | * | 12/1941 | Bloch | 254/1 |
| 3,213,575 | A | * | 10/1965 | Boczek | 52/123.1 |
| 3,248,831 | A | * | 5/1966 | Jones | 52/121 |
| 3,354,599 | A | * | 11/1967 | Martin | 52/745.17 |
| 3,464,169 | A | * | 9/1969 | Potain | 52/115 |
| 3,601,342 | A | * | 8/1971 | Piasecki | 244/137.4 |
| 3,606,719 | A | * | 9/1971 | Bessola | 52/632 |

(Continued)

*Primary Examiner*—Jeanette Chapman
(74) *Attorney, Agent, or Firm*—John W. LaBatt; Hoffman, Warnick & D'Alessandro LLC

(57) ABSTRACT

The invention relates to a covering body for masts of construction cranes, electricity lines, or the like with an outer covering which is designed to partially or totally encase a mast in the direction of extension and/or peripheral direction and which furthermore has at least one rigid inner support, with which the outer covering can be arranged to be spaced at least partially at a distance from the mast. Finally, a fastening device for fastening the inner support to the mast is provided. Such a covering body according to the invention is further developed in that the inner support, by means of the fastening device, can be connected to the mast rotatably adjustable in the peripheral direction and/or adjustable in the direction of extension and that a device for active and/or passive variation of position and/or geometry of the outer covering is provided. A basic concept of the invention is not to make the covering body rigid, but to connect it to the mast so it can move, whereby it can react flexibly to differing loadings by the wind forces. As a result, the application of even covering bodies having large spatial dimensions is possible on free-standing masts.

21 Claims, 4 Drawing Sheets

U.S. PATENT DOCUMENTS 3,736,710 A * 6/1973 Sterner ..... 52/115
3,945,107 A * 3/1976 Houck ..... 29/431
4,337,601 A * 7/1982 Vaerk et al. ..... 52/118
4,480,570 A * 11/1984 Rosenfield et al. ..... 114/106
4,506,480 A * 3/1985 Murrill et al. ..... 52/121
4,558,791 A * 12/1985 Mosley ..... 212/347
4,848,520 A * 7/1989 Gibel et al. ..... 187/223
4,905,620 A * 3/1990 Newton ..... 114/90
5,097,781 A * 3/1992 Meny ..... 114/93
5,168,679 A * 12/1992 Featherstone ..... 52/118
5,333,422 A * 8/1994 Warren et al. ..... 52/115
5,381,867 A * 1/1995 Berry ..... 175/85
5,413,825 A * 5/1995 Chaikin ..... 428/18
5,557,892 A * 9/1996 Lavin ..... 52/121
6,331,838 B1 * 12/2001 Scott et al. ..... 343/715
6,484,456 B1 * 11/2002 Featherstone et al. ..... 52/118
6,494,005 B2 * 12/2002 Zimmerman ..... 52/296
6,494,636 B1 * 12/2002 Mozena ..... 403/109.2
6,546,677 B1 * 4/2003 Featherstone ..... 52/118

* cited by examiner

FIG. 1A
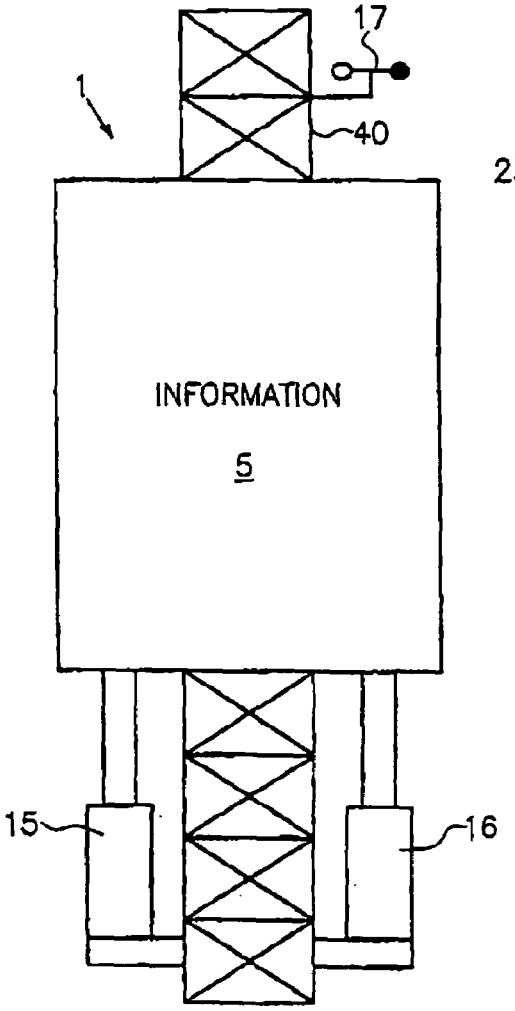
FIG. 1B
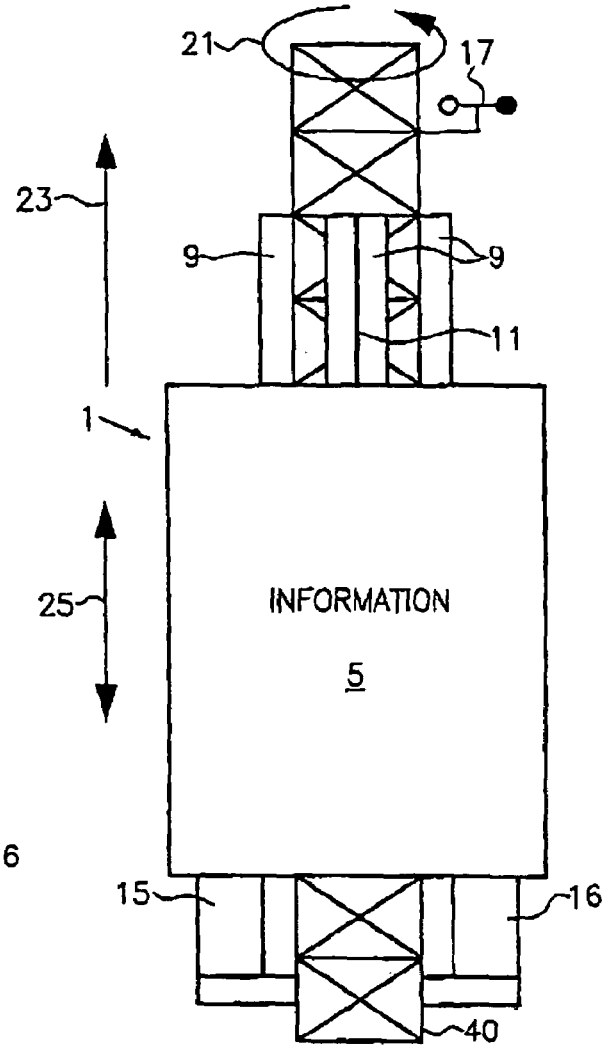
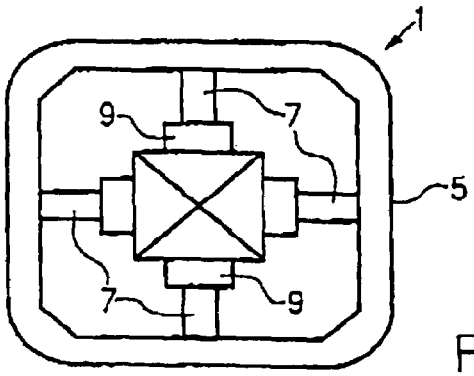
FIG. 1C

ENVELOPING BODY

CLAIM OF PRIORITY

This application claims priority to PCT Application No. PCT/EP00/07598 filed Aug. 4, 2000, which claims the benefit of German Application No. 299 15 269.3, filed Aug. 31, 1999.

FIELD OF INVENTION

The invention relates to a covering body for masts of construction cranes, electricity lines, or the like, according to the generic part of claim 1.

A covering body of such type features an outer covering which is designed to partially or totally encase a mast in the direction of extension and/or peripheral direction and which furthermore has at least one rigid inner support, with which the outer covering can be arranged to be spaced at least partially at a distance from the mast. Finally, a fastening device for fastening the inner support to the mast is provided.

Such covering bodies are used in particular as bulleting and/or advertising boards, for example, in entrances to businesses, petrol stations or shopping centres, at trade fairs, exhibitions, information centres or in museums and the like.

There, required information, graphic advertising and/or required advertising text can be put on the outer covering.

BACKGROUND OF THE INVENTION

These disclosed covering bodies of prior art are specifically attached to suspension masts, stands, framework, lattice structures or the like and are designed relatively small in their geometrical extension.

The larger a covering body of this type is produced, the more one must consider any possible loading due to wind forces with regard to mechanical stability when erecting the covering body outdoors in the open air.

In the case of the disclosed covering bodies of prior art the external covering is rigidly joined to the mast, stand, framework, lattice structure or the like. This results in that such covering bodies, if they are to be suitable for installation outdoors and are to withstand the wind forces which typically occur, the entire construction of the covering body and mast must be designed relatively solid and would therefore be expensive.

For the erection and dismantlement of construction cranes so-called climbing devices are known, which with the aid of a hydraulic system can move along the mast of a construction crane. These climbing devices are taken off after complete erection of the crane and are only then refitted for its dismantlement.

Based on the said prior art, the present invention sets out to provide a covering body for encasing or cloaking of outdoor masts of construction cranes, electricity lines or the like, for which a variation in the covering body, in particular for forces transmitted to the mast through wind effect by way of the covering body, and which would consequently result in causing the design to be of relatively large spatial dimensions, can be built.

DISCLOSURE OF THE INVENTION

This task is resolved by the covering body in accordance with the invention according to claim 1.

Accordingly, it is provided with the covering body of such type, that the inner support, by means of the fastening device, can be connected to the mast rotatably adjustable in the peripheral direction and/or adjustable in the direction of extension and that a device for active and/or passive variation of the position and/or the geometry of the outer covering is provided.

The term "direction of extension" is intended to imply that direction in which the mast to which the covering body is attached basically extends. The term "peripheral direction" is intended to imply a direction surrounding the mast. Th mast can thus be in particular the perpendicular and/or horizontal part of the construction crane.

A basic concept of the invention can be seen in not only joining the covering body rigid with the mast, but movable, in other words rotatably adjustable and/or adjustable in the direction of extension with the mast.

As a result one gains the advantage in that differing loadings through wind forces can be counteracted against in a flexible manner.

Consequently, the fitting of even covering bodies having large spatial dimensions to freestanding masts such as those of construction cranes and electricity lines or the like are made possible.

In a preferred embodiment of the covering body in accordance with the invention the inner support features frame construction surrounding a zone of the mast for the outer covering and the fastening device is designed as a mast fastening, in particular as a lattice mast fastening.

In so doing, it is advantageous if the lattice mast fixing is located so that it can rotate and/or roll in the peripheral direction and/or slidably move in the direction of extension in respect to the mast, in particular on one or a plurality of rails. For this purpose, rollers or wheels can, for example, be provided. In addition, the lattice mast fixing can be subjected to loading for flexing or feature a frame construction itself, which can be loaded for flexing.

Much preferred for this is an embodiment of the invention in which a sensing device is provided for determining the wind speed and/or wind direction and with which the geometry of the outer covering and/or the positioning thereof can be automatically matched to suit momentary wind conditions for reducing of wind forces over the covering body on the mast. Through variation in the geometry a reduction in the flow resistance caused by the outer covering can be attained. The forces transmitted by the wind forces over the outer covering to the mast and/or moments of torque can, in addition to just altering the geometry of the outer covering, also be reduced by a variation of position.

Monitoring and, if need be, changing of position and/or geometry of the outer covering by operating personnel can thus be dispensed with for this form of arrangement and the covering body can remain at any time in an operative state, for example, high on the mast of a construction crane.

The sensing device for determining the wind speed and/or the wind direction can thus be fitted to the mast or even to the outer covering of the covering body.

With regard to the automatic matching of the covering body to suit momentary wind conditions a further embodiment of the covering body is preferred, in which a rotary drive and/or linear drive for actuating the setting of the geometry and/or position of the outer covering is provided. In so doing, it can involve the use of electro-motors, hydraulic drives or pneumatic drives or the like.

Adaptation of the geometry of the outer covering can be attained in a particularly simple manner firstly in that the outer covering is designed to be variable in the direction of extension and/or in radial direction. Radial direction here is intended to mean all directions perpendicular in relation to the direction of extension.

In order to facilitate the matching of the geometry of the outer covering to suit momentary wind conditions, additional design embodiments of the covering body in accordance with the invention may be preferred, in which the outer covering features a plurality of part pieces arranged in peripheral direction or a plurality of segments arranged in the direction of extension.

It can, in particular, be of advantage to design the covering body so that segments are designed to rotate in peripheral direction independently of each other. Any possible torsional loadings on the covering body occurring through the effect of wind can with such a construction merely be loaded on an individual segment and accordingly are relatively weak. In general this facilitates less stiffening to be provided to counteract torsion and twisting and thus results in a less expensive construction.

Another adaptation to the geometry of the outer covering, which is technically simple to implement, can be achieved by the segments being designed to slide telescopically in each other in the direction of extension. With a suitable number of segments in this way a particularly large reduction in the flow resistance can be attained through the segments moving in each other.

Relatively inexpensive in terms of manufacture and design are covering bodies, the external form of which in the direction of extension is designed rotationally symmetrical. This means that for these covering bodies the cross section of external form features an essentially circular form perpendicular to the direction of extension. Furthermore, these covering bodies are characterised by good statical mechanical properties.

In the case of preferred design variants of this embodiment the external form of the covering body is designed shaped spherically, paraboliodally, hyperboliodally, ellipsoidally or bottle-shaped. All these external forms also feature beneficial flow properties with good mechanical stability.

The covering body can, in addition, be designed, such that the cross section of the outer covering features an elliptical, square, rectangular, triangular, regular polygonal or a flow-favourable drop profile. These technical solutions are either characterised by particularly simple design implementation and/or by particularly favourable flow properties.

By a simple embodiment of the covering body the outer covering is made primarily of a rigid material. It can be sheet, in particular aluminium sheet or plastic panels. Such covering bodies can be produced speedily and effectively, for example, through simple riveting, screw fastening and/or bonding of the sheets or panels with the inner support, which can be designed as a complete internal structure.

A reduced transfer of wind forces to the mast by way of the covering body can be attained by an embodiment of the covering body in which the outer covering is basically designed from a wind penetrable wire lattice. Although such a wire lattice allows the passage through of the wind, it appears to the observer, especially at great distances, optically dense, such that the reduced flow resistance is not acquired at the expense of losing area for displaying information.

By another large group of preferred variants of the covering body in accordance with the invention the outer covering is basically designed from a flexible material. This can involve wind penetrable textile material, especially a synthetic material or even a plastic film. Due to the relatively low weight of such flexible materials the construction of the covering body can in general be kept lighter. Furthermore, outer coverings, having various contours, can be implemented inexpensively. Even with these variants the inner support is preferably designed as a complete inner lattice structure.

Another possibility to vary the geometry of the outer covering exists in that the outer covering is designed partially or completely foldable. As a result, provision can be made in particular such that the outer covering is designed to fold together in the direction of extension in a bellow like manner. With this variant a particularly wide variation in flow resistance can also be achieved. At the same time, this technical solution can be effected in a simple manner, since the outer covering in the simplest case is only moved together, respectively drawn apart in one direction.

Furthermore, provision can also be made for the outer covering to be designed at least in part so that it can roll in. This has the advantage that the flexible material of the outer covering can remain tensioned at all times and therefore cannot flap in the wind.

Another possibility to achieve differing contours for the outer covering exists in that at least parts of the outer covering are designed for being able to be inflated. Consequently, it is especially advantageous to make provision for equipment to inflate and deflate by means of pumping at least from sections of the outer covering. This variant can be preferable if relatively complicated forms of the outer covering are required, wherein inflation can be accomplished extremely rapidly, for example using pressurised cartridges.

In order to enable or improve perception of the covering body respectively the outer covering thereof, technical developments are preferred in which at least internally or externally of the covering body a luminaire is provided. If the luminaire is arranged within the covering body, then it is advantageous to design the outer covering transparent at least in part.

Particularly good perception of the outer covering, especially when dark, is attained, such that the outer covering features active illuminating elements. This can involve the use of filament bulbs and/or discharge lamps, illuminating diodes, fluorescent and/or phosphorescent material.

In order to attain a stable connection of the covering body to a mast, it is preferred that the lattice mast fastening features hook-in devices to create a force engaging connection. In so doing, the hook-in devices are designed advantageously to be able to be fixed and/or to be interlockable.

With regard to the securement of the covering body at different parts of a construction crane, variants of the covering body in particular may ultimately be preferred, in which the outer covering and the fastening device for fixing the covering body are mounted on the perpendicular or horizontal part of a construction crane.

Other advantageous designs of th invention are ultimately characterised in that the outer covering is designed for a sail-like arrangement between the perpendicular and horizontal part of a construction crane. This enables a particularly large utilisable area to be acquired for display purposed of information or advertising.

In a preferred variant the outer covering extends in the installed state of the covering body essentially beneath the horizontal part of the construction crane.

In principle the outer covering, however, can extend into all zones between the perpendicular part and the horizontal part of the construction crane. This means, design forms can even be chosen, with which the outer covering extends at least partially above the horizontal part of the crane in the installed state of the covering body.

With designs of the covering body having a sail-like outer covering, provision can be made, where local conditions may allow such a provision, for the construction crane to freely rotate around its perpendicular axis during times when the crane is out of use, such as evenings or at the weekends.

As a result, the horizontal jib of the construction crane will position itself automatically in the direction of the wind. Firstly, this has the advantage that the forces and moments of torque transmitted by the outer covering onto the construction crane can be kept very small. Secondly, in the event of a changing wind direction this would allow the outer covering to be seen from various directions.

In addition, it is particularly beneficial with a sail-like design of the covering body due to the high flow resistance of such a sail to design at least parts of the outer casing to roll in, draw in and/or fold together in a horizontal direction, in a perpendicular direction and/or in another direction.

In so doing, the operation of rolling in, drawing in or folding together can be preferably automated and controlled in relation to the wind speed measured.

In order to achieve the most efficient use of the outer covering, the outer covering can feature variable external surfaces, wherein it can involve more especially so-called motion displays.

The variable external surfaces can alter over time, for example be formed in an alternating manner in respect of time.

Furthermore, the variable external surfaces can feature a plurality of laminations, which, for example, can be arranged horizontally or perpendicular. In the case of the variable external surface, it can however also involve a surrounding rotatable roller.

The basic concept of this invention to design a covering body, such that the geometry thereof and/or position can be varied, is accomplished in a particularly effective manner if the covering body in accordance with the invention for encasing and/or cloaking of masts of construction cranes, electricity lines or the like is used.

BRIEF DESCRIPTION OF THE DRAWINGS

The invention is explained in further detail in the following with the aid of design examples depicted schematically on drawings.

Shown on these drawings are:

FIG. 1A a first example of a covering body in accordance with the invention on a mast in a first state of setup;

FIG. 1B the covering body from FIG. 1A on a mast in a second state of setup;

FIG. 1C a cross section perpendicular to the direction of extension of the covering body from FIGS. 1A and 1B;

FULL DESCRIPTION OF THE INVENTION

Figure 2A:
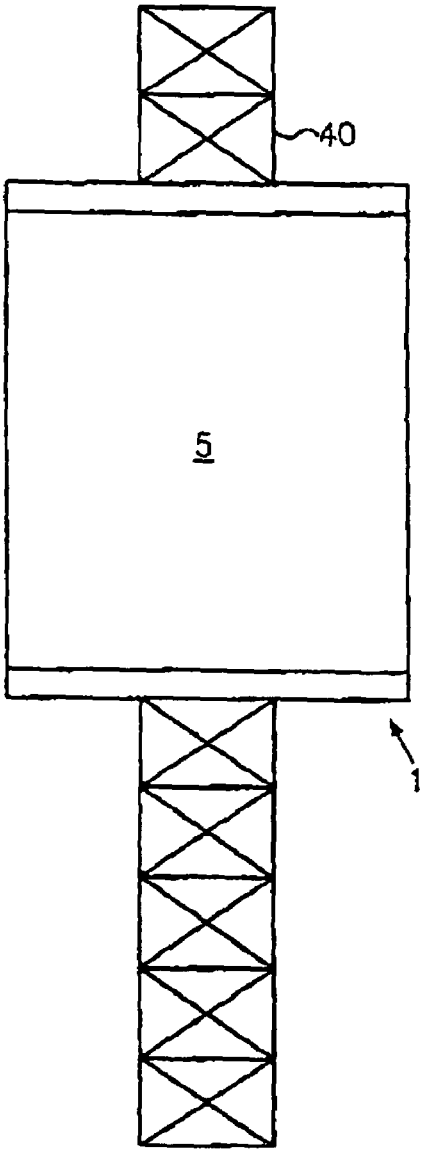
FIG. 2A a second example of a covering body in accordance with the invention in a state of encompasssment.

In the example of a covering body in accordance with invention depicted in FIG. 1A an outer covering 5 is provided, which in this design embodiment is manufactured from a rigid material, for example from an aluminium sheet or from plastic panels.

The outer covering 5 is fixed to inner supports 7, which on their part are connected to the mast 4 by way of a multiplicity of fastening devices 9. For this purpose, rails 11 are formed in each case in the fastening devices 9, in which the inner supports 7 are located for movement.

To move the outer covering 5 in a direction of movement 25 parallel to the direction of the extension 23 of the mast linear motion drives 15, 16 are provided, which are designed as hydraulic drives.

The inner support 7 is provided with a frame construction 27, which completely surrounds the mast 4 and which supports the outer covering 5.

The illustrated covering body 1 totally surrounds the mast 4 in its peripheral direction 21.

In addition a measuring device 17 is provided for determining the wind speed, wherein the readings are constantly logged by a control and regulator unit, which is connected to the hydraulic drives 15, 16.

If the wind strength exceeds a given critical preset value entered into the regulator device, the regulator device emits a signal to the hydraulic drives 15, 16, upon which the said hydraulic drives move the covering body downwards. In this manner the wind forces and moments of torque transmitted to the mast 4 by way of the covering body 1 and thus the risk of toppling of the mast are reduced.

Figure 2B:
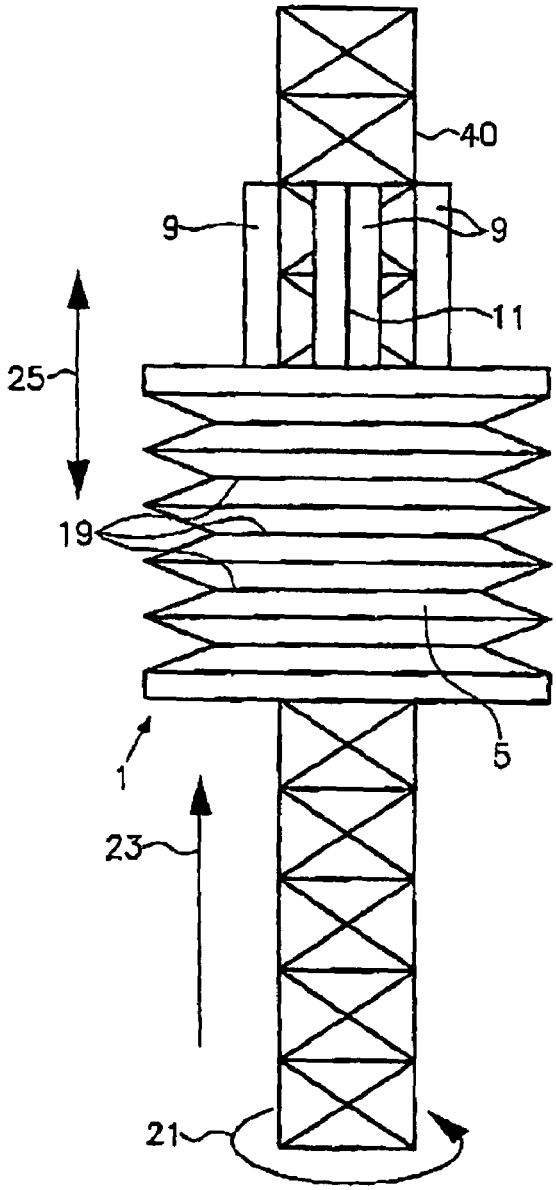
FIG. 2B the covering body from FIG. 2A in a partially drawn in state.
Figure 3A:
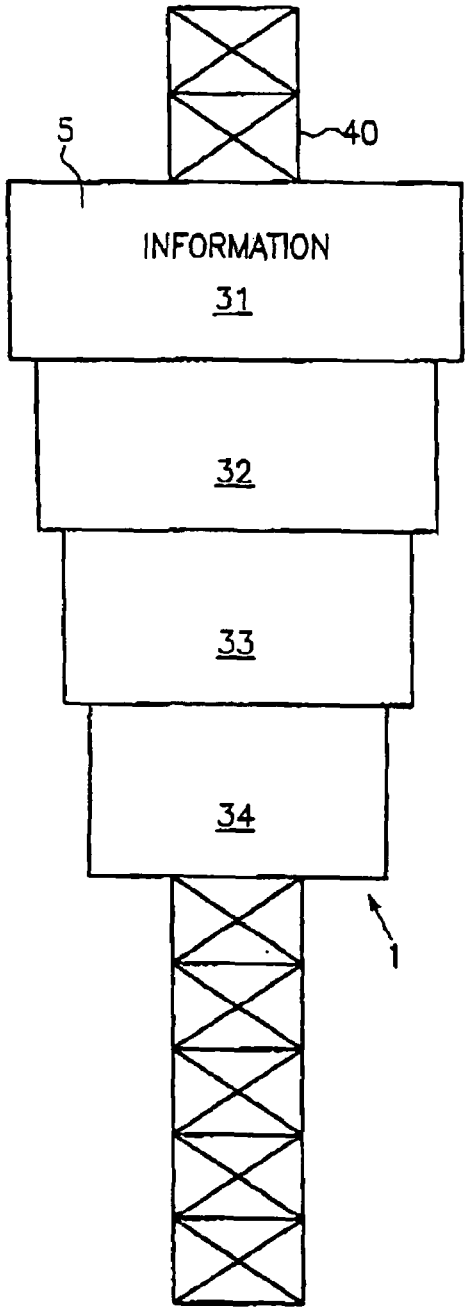
FIG. 3A a third example of a covering body in accordance with the invention in a covering state.
Figure 3B:
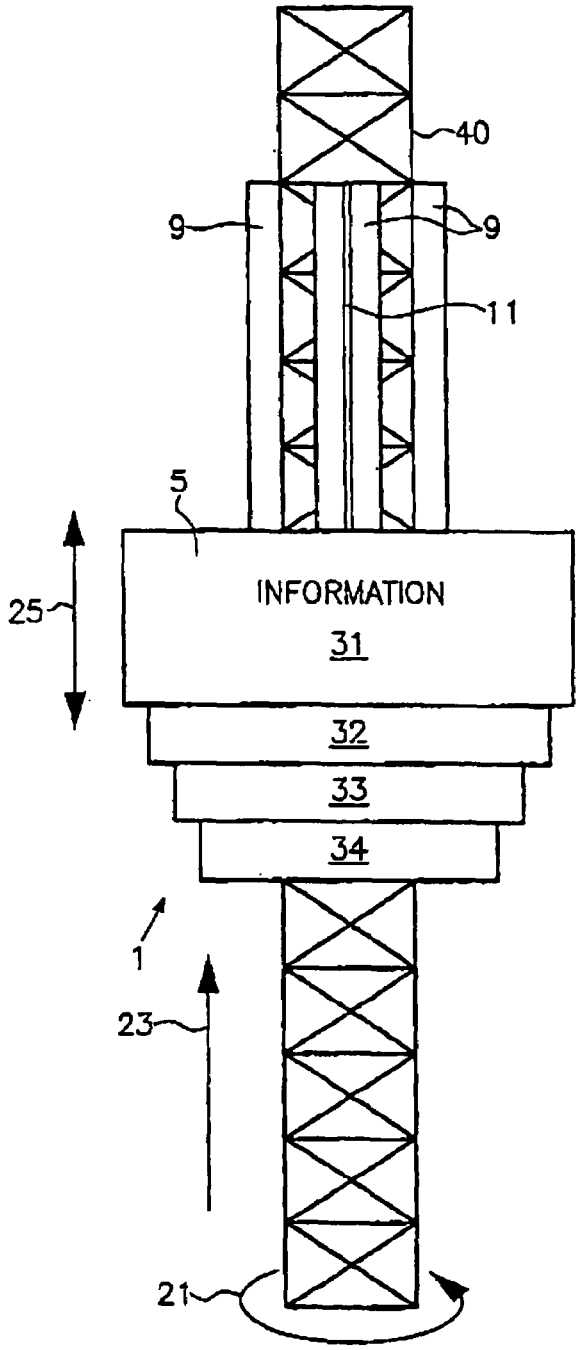
FIG. 3B the covering body from FIG. 3A in a partially drawn in state.

In the embodiments of the covering body 1 in accordance with the invention depicted in the FIGS. 2A and 2B respectively 3A and 3B can in contrast to the variant depicted in the FIGS. 1A to 1C not only alter the position but also the geometry of the covering body 1.

Equivalent parts are denoted in the FIGS. 2A, 2B, 3A and 3B in each case by the same reference-characters as denoted in the FIGS. 1A to 1C.

The embodiments of FIGS. 2A, 2B, 3A and 3B, too, surround in each case the mast 4 in the peripheral direction 21 thereof. The top part of the outer covering 5 can be moved in the direction of movement 25 parallel to the direction of extension 23 of the mast in these forms of embodiment. In addition, inner supports 7 can be moved in each case in an equivalent manner as FIG. 1C depicts by way of fastening elements 9 connected to the mast, wherein once again rails 11 in the fastening devices 9 are provided for movable location of the inner supports 7.

Initially the two design examples of FIGS. 2A, 2B, 3A and 3B work in the same manner in that the extension of th outer covering 5 can alter in th direction of extension 23. However, the designs differ on the principle of geometric variation of the outer covering 5.

In the second embodiment depicted in the FIGS. 2A and 2B the outer covering 5 can be drawn together in the manner of a bellows, whereby the alteration in extension of the outer covering 5 is attained in the direction of extension 23. In the third embodiment depicted in the FIGS. 3A and 3B however the outer covering 5 is constructed in total of four segments 31, 32, 33 and 34, which can be pushed into each other. Through this an alteration in the extension of the outer covering can once again be accomplished in the direction of extension 23.

In the second and third design example a measuring device 17 (not depicted) is once again provided in each case for determining the speed of the wind, which in its part is connected to a control unit. As soon as the wind speed exceeds a critical value, the control unit ensures that the outer covering 5 of the covering body 1 is drawn together. By doing this the flow resistance and thus the forces and moments of torque transmitted onto the mast 4 by way of the covering body 1 through the wind forces are significantly reduced.

If the wind speed now drops below a certain second critical value, then provision in terms of control can be made so that the outer covering 5 is extended out once again to its full length, or in the case of the first embodiment in the FIGS. 1A to 1C driven upwards yet again.

Figure 4:
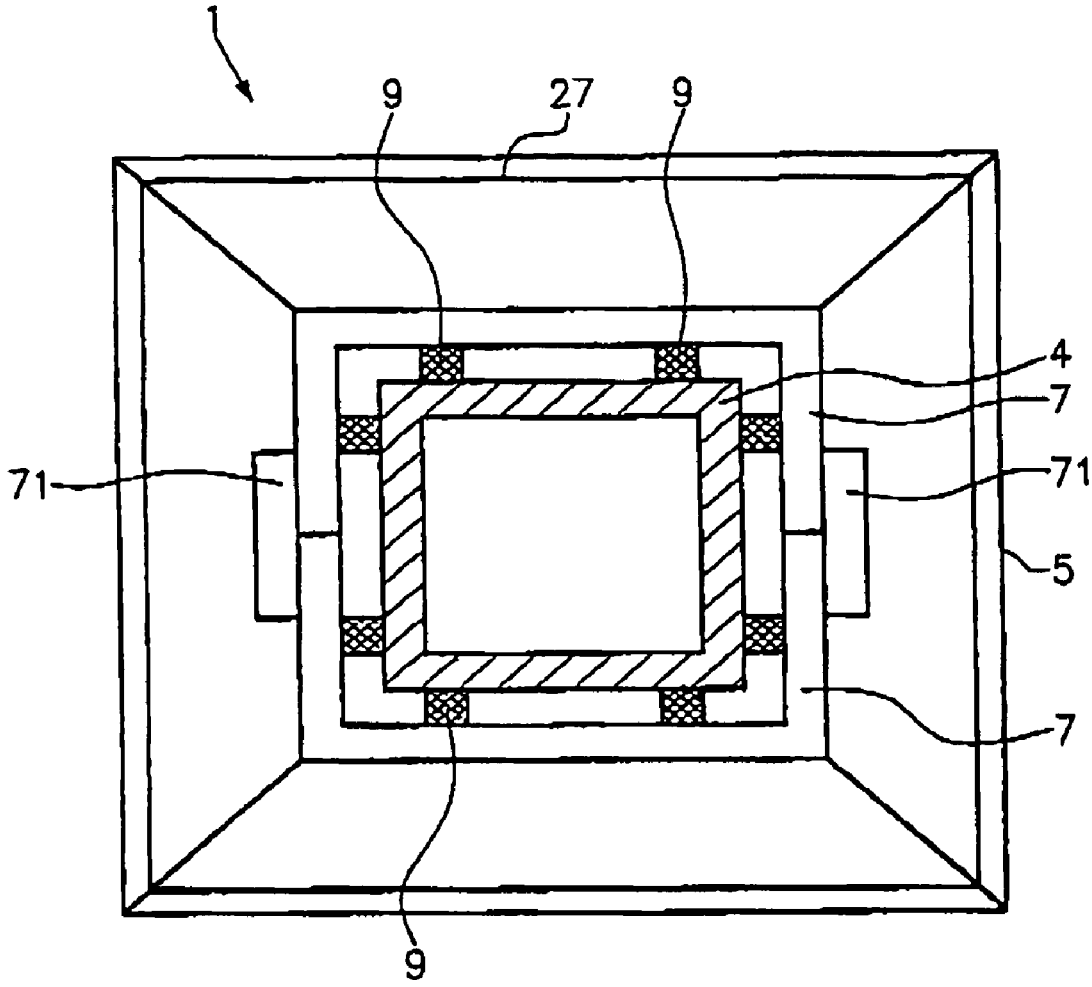
FIG. 4 a cross-section through a fourth example of a covering body in accordance with the invention.

In FIG. 4 is depicted a cross section by a fourth embodiment of a covering body 1 in accordance with the invention. A mast 4 is hereby completely surrounded by an inner support 7 comprising two U-shaped parts. The two parts of the inner support 7 are screwed together by fixing plates 71. The inner support 7 also features a frame construction 27 upon which the outer covering 5 made of the flexible material is tautly tensioned. To ensure moveabilty along the direction of extension of the mast 4 the fastening devices 9 are designed as rollers, which are located in non-depicted rails in this design example.

What is claimed is:

1. A covering body bulletin board for a mast, the covering body comprising:

an outer covering, wherein the outer covering is designed to encase at least a portion of the mast and is designed to include at least one of required information, graphic advertising and required advertising text;

at least one rigid inner support for holding at least a portion of the outer covering a distance from the mast;

a fastening device for fastening the inner support to the mast and adjusting the inner support in a direction of extension with respect to the mast; and a device for adjusting at least one of a position and a geometry of the outer covering with respect to the mast to reduce a force of wind on the mast.

2. The covering body of claim 1, wherein the inner support comprises a frame that surrounds a zone of the mast.

3. A covering body, comprising:

an outer covering for encasing a mast;

at least one rigid inner support positioned between the mast and the outer covering;

a fastening device for fastening the inner support to the mast, wherein the inner support is adjustable in a direction of extension with respect to the mast;

a linear drive for adjusting the outer covering with respect to the mast; and a measuring device for measuring a wind speed, and wherein a position of the outer covering can be varied based on the measured wind speed.

4. A covering body, comprising:

an outer covering for encasing a mast;

at least one rigid inner support positioned between the mast and the outer covering;

a fastening device for fastening the inner support to the mast, wherein the inner support is adjustable in a direction of extension with respect to the mast;

a linear drive for adjusting the outer covering with respect to the mast; and a measuring device for measuring a wind speed, and wherein a geometry of the outer covering can be varied based on the measured wind speed.

5. The covering body of claim 1, wherein the outer covering comprises a plurality of segments that are operable to rotate independently and slide telescopically into each other.

6. The covering body of claim 1, wherein an outer form of the covering body is rotationally symmetrical.

7. The covering body of claim 1, wherein the outer covering is rigid.

8. The covering body of claim 7, wherein the rigid outer covering comprises at least one of an aluminum sheet, plastic panels, and a wind penetrable wire lattice.

9. The covering body of claim 1, wherein the outer covering is flexible.

10. The covering body of claim 1, wherein the outer covering is foldable.

11. The covering body of claim 10, wherein the outer covering comprises foldable bellows.

12. The covering body of claim 1, wherein a portion of the outer covering is inflatable.

13. The covering body of claim 1, wherein the outer covering comprises at least one illuminating device.

14. The covering body of claim 1, further comprising a roller device for moving the covering body relative to the mast.

15. A covering body, comprising:

an outer covering for encasing a mast, wherein the outer covering is designed to encase at least a portion of the mast and is designed to include at least one of required information, graphic advertising and required advertising text;

a plurality of rigid inner supports connecting the mast to the outer covering;

a plurality of fastening devices for fastening the inner supports to the mast, wherein the inner supports are adjustable in a direction of extension with respect to the mast; and means for adjusting the outer covering with respect to the mast to reduce a force of wind on the mast.

16. The covering body of claim 15, wherein the outer covering comprises foldable bellows.

17. The covering body of claim 15, wherein the outer covering comprises a plurality of telescoping sections.

18. A covering body, comprising:

an outer covering for encasing a mast, wherein the outer covering is designed to encase at least a portion of the mast and is designed to include at least one of required information, graphic advertising and required advertising text;

a plurality of rigid inner supports connecting the mast to the outer covering;

a plurality of fastening devices for fastening the inner supports to the mast, wherein the inner supports are adjustable in a direction of extension with respect to the mast; and a linear drive for adjusting the outer covering with respect to the mast to reduce a force of wind on the mast.

19. A covering body, comprising:

an outer covering for encasing a mast;

a plurality of rigid inner supports connecting the mast to the outer covering;

a plurality of fastening devices for fastening the inner supports to the mast, wherein the inner supports are adjustable in a direction of extension with respect to the mast; and a linear drive for adjusting the outer covering with respect to the mast; and a measuring device for measuring a wind speed, wherein the outer covering is adjustable based on the measured wind speed.

20. The covering body of claim 3, which is designed as at least one of an advertising board and a bulletin board.

21. The covering body of claim 1, wherein the fastening device adjusts the inner support in either direction of extension with respect to the mast.

* * * * *